United States Patent [19]

Lüling

[11] 4,048,822

[45] Sept. 20, 1977

[54] LOCKS FOR DOORS AND THE LIKE

[75] Inventor: Adalbert Luling, Meinerzhagen, Germany

[73] Assignee: Firma F. W. Lüling KG, Volmarstein, Germany

[21] Appl. No.: 352,056

[22] Filed: April 17, 1973

[30] Foreign Application Priority Data

Apr. 17, 1972 Germany ..... 2218574

[51] Int. Cl.[2] ..... E05B 65/00

[52] U.S. Cl. ..... 70/93; 292/262; 292/DIG. 44

[58] Field of Search ..... 70/93, 89; 292/262, 292/263, 274, DIG. 44, 264

[56] References Cited

U.S. PATENT DOCUMENTS

| | | | |
|---|---|---|---|
| 341,489 | 5/1886 | Ladd | 292/262 |
| 365,536 | 6/1887 | Phillips | 292/263 |
| 1,612,728 | 12/1926 | Johanning | 70/93 |
| 2,407,900 | 9/1946 | Paul | 70/93 |
| 2,555,329 | 6/1951 | Foster | 292/263 |
| 3,869,886 | 3/1975 | Diaz | 70/93 |

FOREIGN PATENT DOCUMENTS

| | | | |
|---|---|---|---|
| 559,697 | 4/1931 | Germany | 70/93 |

*Primary Examiner*—J. Franklin Foss
*Attorney, Agent, or Firm*—Ernest G. Montague; Karl F. Ross; Herbert Dubno

[57] ABSTRACT

A door lock, requiring no penetration of a door leaf for unlocking from the outside, comprises a keeper secured to the inner surface of the door leaf, a housing slidably articulated to the keeper by two pivot studs, and a detent on an adjoining door post engageable by a pair of spring-loaded levers in the housing whose fulcra are a pair of pins normally immobilized by a retaining disk. With the door closed and the detent engaged, the housing fits around the keeper and can move away from it to a limited extent, allowing the door to be opened slightly, unless a handle on the housing is turned into a latching position engaging a bolt fixed to the keeper. Unlatching of the door from within, by reverse rotation of the handle, also disengages the levers from the detent so that the door can be opened wide. When the door is opened from the outside, its leaf is held ajar by the housing whose handle cannot be rotated in this position since the levers are blocked by the pivot studs. With the aid of a key, however, the retaining disk can be rotated to free the fulcral pins whereby the levers can be spread apart to release the housing from its detent.

24 Claims, 10 Drawing Figures

LOCKS FOR DOORS AND THE LIKE

FIELD OF THE INVENTION

My present invention relates to a door lock of the type wherein a keeper mounted on the inner surface of a door leaf, i.e. on the side toward which the door swings on being opened, is releasably connected with a detent on an adjoining door post with the aid of a link enabling the door to be opened but slightly form the outside unless the link is disabled through the use of a key.

BACKGROUND OF THE INVENTION

It is known to design such a link as a housing containing an unlocking mechanism whose keyhole is accessible from the outside, with the door ajar to the extent permitted by the engaged link, through the gap then existing between the door leaf and the door post. Such an arrangement enables the lock assembly to be installed without penetration of the door leaf to facilitate the insertion of a key.

OBJECTS OF THE INVENTION

An object of my present invention is to provide an improved door lock of the aforedescribed type which is of pleasing appearance and easy to operate.

Another object is to provide a lock of this character which can be conveniently released from the inside when the door is closed but wherein such release is positively prevented in the partly open position.

SUMMARY OF THE INVENTION

In accordance with my present invention, the link releasably connecting the keeper on the door leaf with the detent on the door post has a track permanently engaged by pivot means on the keeper whereby the link is slidably articulated to the keeper, this track extending from one end of the link to the opposite end. At the first-mentioned end the link is provided with gripper means for engaging the detent, the gripper means being disengageable from the detent by key-operable unlocking means accessible through the gap existing between the door leaf and the door post upon limited displacement of the door leaf away from the door post to the extent determined by the length of the track.

Advantageously, the link is designed as a housing which fits around the keeper in a normal position, the pivot means then lying close to the end of the housing provided with the gripper means. The keeper preferably comprises a back plate provided with a pair of parallel formations, such as ribs perpendicular to that back plate extending laterally therebeyond, these formations carrying a pair of confronting studs representing the pivot means. The housing may have a substantially rectangular outline and may be closed at its rear by a cover separated from the peripheral housing wall by longitudinal clearance receiving these ribs, the track for the pivot studs being then formed by a pair of bent-over lips on the cover lying adjacent the longitudinal clearances. Internal ledges on the peripheral housing wall may form abutments for the ribs in the normal position in which the cover of the housing rests against the back plate of the keeper.

According to a further feature of my invention, I provide the keeper with manually operable means for disengaging the gripper means from the detent independently of the key-operable unlocking means, the release means being blockable by a positioning of the pivot studs adjacent the end of the housing remote from the gripper means which is where the studs are located when the door is ajar with the link engaged. For this purpose I prefer to provide a pair of substantially mirror-symmetrical levers within the housing whose first extremities constitute the gripper means coacting with the detent and whose opposite second extremities are flanked by the pivot studs of the keeper in their aforedescribed blocking position. These levers carry respective pins normally immobilized by the unlocking mechanism, more particularly by slits of a retaining disk whose rotation with the aid of the proper key frees the pins from the slits but which normally constitute fulcra for the two levers about which they can be swung against a spring force from an engaging position to a disengaging position. With the fulcral pins released upon rotation of the retaining disk into an unlocking position, the first lever extremities can be disengaged from the detent even though the second lever extremities are blocked by the pivot studs.

Pursuant to a further feature of this invention, I provide the keeper with a latch member such as a bolt having an undercut engageable by the manually operable release means in the normal position, in which that latch member extends into the link housing, to prevent the limited displacement of the door leaf relative to the door post so that the door cannot be opened from the outside even by a crack. The release means may then comprise a rotatable plate with a shaft penetrating the front wall of the housing and carrying a handle, the plate being also provided with a pair of camming elements such as pins flanking the shaft to coact with the second lever extremities. The latch bolt may have a spherically convex head, overlying its undercut, to facilitate its introduction via a corresponding opening in the housing cover.

The detent fastened to the door post advantageously consists of an arm bent into an L-shaped hook which is provided with a mounting plate and whose free end is T-shaped, the bar of the T forming two lateral projections overlying the first lever extremities in the engaging position. In this way only a relatively small part need be fastened to the door post so as to not to mar its appearance. Such an L-shaped hook with lateral projections can be coupled in a particularly simple manner with the connecting link.

The free end of the L-shaped hook advantageously faces away from the door opening. In this way the connecting link can readily swing on the T-bar upon a slight opening of the door.

The lateral projections formed by the T-bar of the L-shaped hook are advantageously provided with oblique surfaces which, upon the closing of the door, effect a spreading apart of the associated lever extremities. Thus, upon the closing of the door, the lever extremities acting as the gripping means snap behind the free end of the L-shaped hook.

In order to receive the lateral projections of the T-bar, I prefer to provide the link housing with internal seats for these projections opposite a cutout in the cover accommodating the L-shaped hook. In this way, the T-shaped free end of the hook is swingably supported inside the housing in a particularly simple fashion.

BRIEF DESCRIPTION OF THE DRAWING

The above and other features of my invention will now be described in detail with reference to the accompanying drawing in which.

Figure 4:
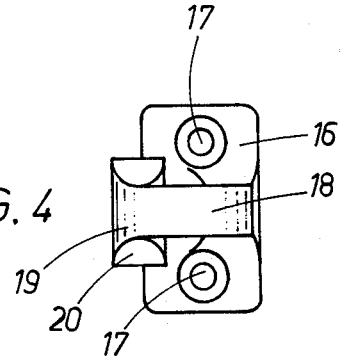
FIG. 4 is a front view of a detent which is to be fastened to the door post.
Figure 3:
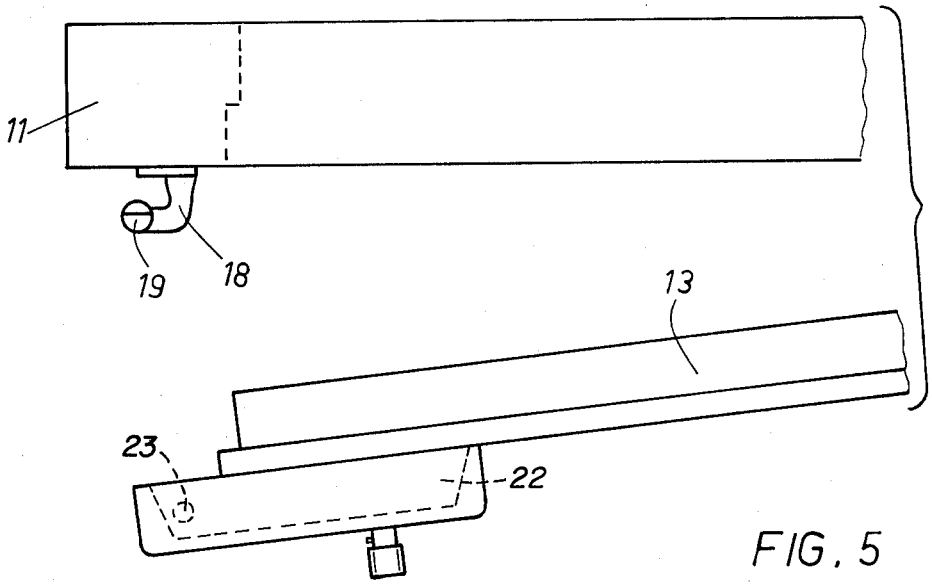
FIG. 3 is a top view of the lock, with the door completely open.

As can be noted in particular from FIGS. 3 and 4, the detent 12 consists of an arm bent into an L-shaped hook 18 provided with a mounting plate 16 with holes 17 for fastening screws (not shown), the free end of this hook being T-shaped with two lateral projections 19 formed by the bar of the T. The free end of the L-shaped hook 18 faces away from the door opening. The lateral projections 19 of hook 18 are provided with oblique surfaces 20.

The keeper 14 comprises a substantially rectangular plate 21 having screw holes (not shown) by means of which the plate 21 can be fastened to the door 13. The horizontally extending longitudinal edges of the plate 21 are angularly bent into ribs 22 which are approximately perpendicular to the surface of door 13. The ribs 22 are provided along confronting sides with pivot pins or studs 23 slidably articulating the keeper 14 to the link 15. The pivot pins 23 are carried on those ends of the ribs 22 which face the detent 12 and which project laterally beyond the door 13 so that the link 15 can be swung past that vertical edge.

The link 15 consists of a substantially rectangular housing 24 having a front wall 25 and sidewalls 26 and 27. The rear side facing the door 13 is provided with a cover 28. The substantially rectangular cover is provided, at its end proximal to the door post 11, with projections 29 for engagement in corresponding apertures 30 in one sidewall 26 of the housing 24, while on the other end of the cover a hole 31 is provided for the introduction of a fastening screw 32 which can be screwed into an aligned threaded bore 33 in a boss 67 in the opposite sidewall of housing 24.

The cover 28 has an opening 34 for the introduction of the T-shaped free end of the detent 12 which can thus enter the housing 24. The cover 28 is of such a width that slots 36, forming clearances for the insertion of ribs 22 of plate 21, remain between the longitudinal edges 35 of the cover 28 and the upper and lower walls 27 of the housing 24. In this way the housing 24 can fit around the plate 21 of keeper 14 and the ribs 22 thereof. The pivot pins 23 provided on the ribs 22 come to lie behind the inbent longitudinal edges 35 of the cover 28 forming a track therefor. As a result, the cover can be produced from a relatively thin piece of sheet metal since it is sufficiently strengthened by the bent longitudinal edges 35.

Figure 1:
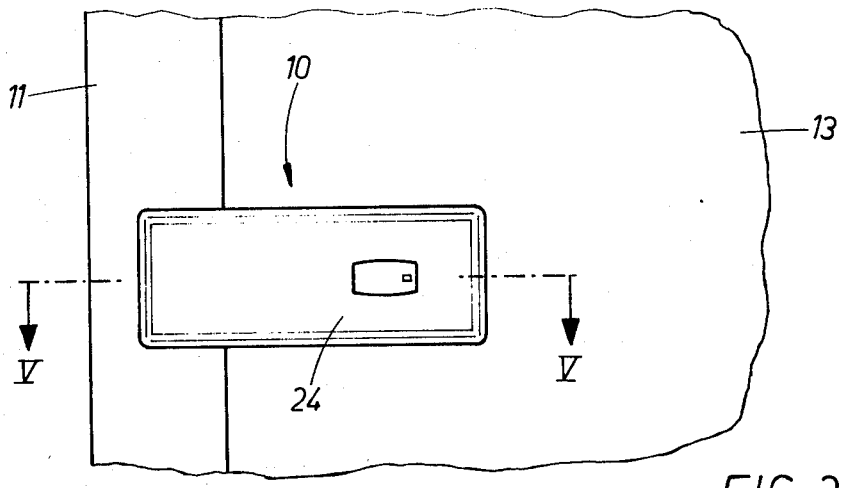
FIG. 1 shows a front view of a lock according to the invention, with the door closed.
Figure 2:
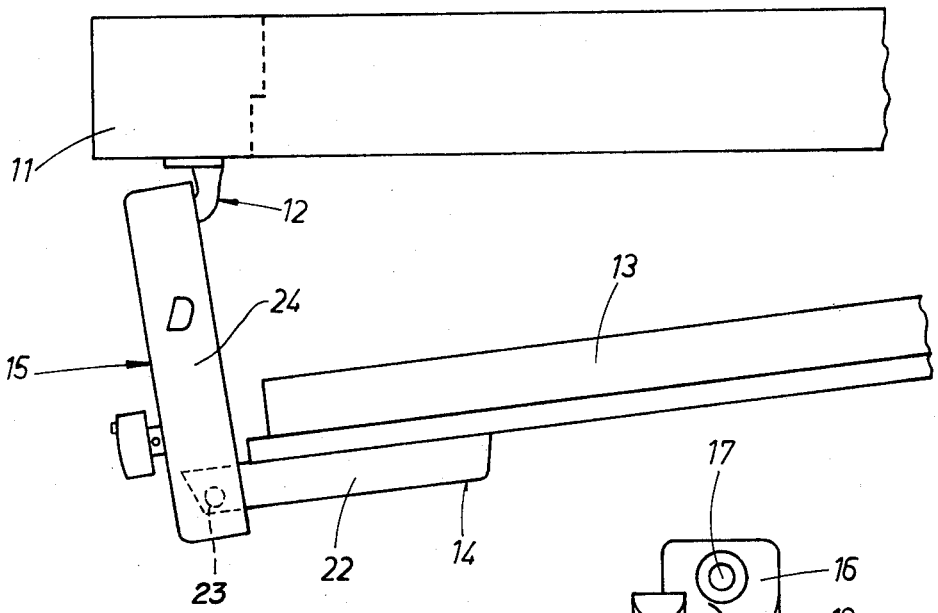
FIG. 2 is a top view of the lock with the door ajar.

The housing 24 is provided on the inner sides of the longitudinal walls 27 with strips 37 forming internal ledges against which the front edges 38 of the ribs 22 of the plate 21 come to rest. In this way the pivot pins 23 are held in contact with the track-forming longitudinal edges 35 of the cover 28 and housing 24 is securely held on the pivot pins or studs 23 so as to be swingable thereabout. Furthermore, the housing 24 can be displaced in longitudinal direction on the pivot pins 23 which lie close to the engagement end of the housing in its normal position (FIG. 3) but shift to its opposite end in the alternate position in which the door 13 is ajar (FIG. 2).

For the coupling and uncoupling of the detent 12 with the link 15 there are provided in the housing 24 two levers 39 of approximately mirror-symmetrical configuration which intersect each other in the manner of shears and are relatively swingable by virtue of arcuate guide slots 40 in their central regions traversed by a pin or dowel 41 mounted on the cover 28. As a result, the levers 39 can be inserted together with the cover 28 into the housing 24. The ends 42 of the levers 39 which face the detent 12 (referred to above as first extremities) are overlain, in the engaging position, by the lateral projections 19 of the hook 18 fastened to the door post 11 the two levers ends 42 being separable against the force of a spring 43. The lever ends 42 are provided in the region of the spring 43 with confronting stops 44 contacting each other in the gripping position of the levers 39. As a result, the lever ends 42 are spaced apart from each other in their stable position (FIGS. 6 and 7) so that upon the closing of the door 13 the oblique surfaces 20 of the lateral projections 19 can separate the extremities 42 until they fall in behind the lateral projections 19.

In order to accommodate these projections 19, the housing 24 has internal seats 45 which conform to the shape of the lateral projections 19 and between which a recess 46 is provided to receive the L-shaped hook 18. The concave shape of the seats 45, best seen in FIG. 5, allows the housing 24 to swing around the lateral projections 19. The lever ends 42 which cooperate the lateral projections 19 are offset from the midplane or housing 24 and therefore from the path of studs 23, so as to rest against the cover 28, while the other parts of the levers 39 are arranged approximately centrally in the housing 24.

Figure 5:
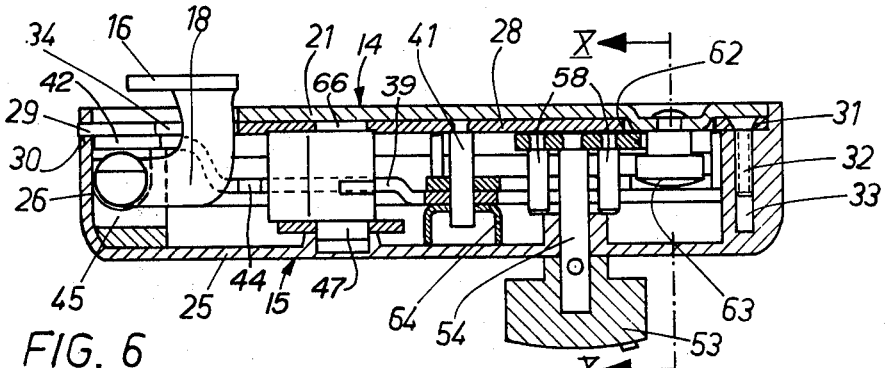
FIG. 5 is a sectional view taken along the line V-V of FIG. 1.

Between the two lever ends 42 within the region of the spring 43 there is provided a lock cylinder 47 whose key channel 48 is accessible through the cover 28 via a keyhole 66 (FIG. 5). Together with the lock cylinder 47 there is rotatable retaining a disk 50 having cams 49; upon rotation of the disk from the position of FIGS. 6–8 to that of FIG. 9 the cams act on two pins 51 provided on the levers 39 so as to spread the extremities 42 apart. When the door is ajar, the link 15 can thus be disconnected by a key from the detent 12 so that the door can be opened completely.

Figure 6:
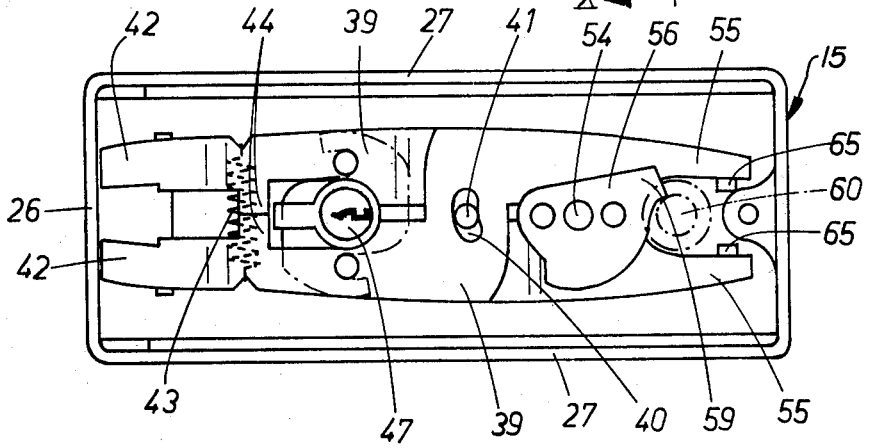
FIG. 6 shows a connecting link of the lock with its cover removed.
Figure 7:
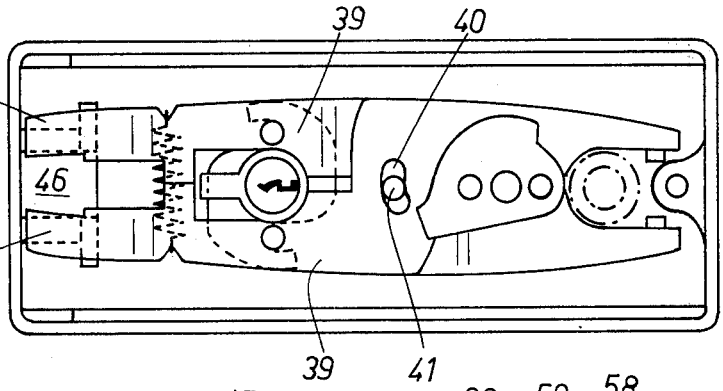
FIGS. 7–9 are views similar to FIG. 6, showing the link.
Figure 8:
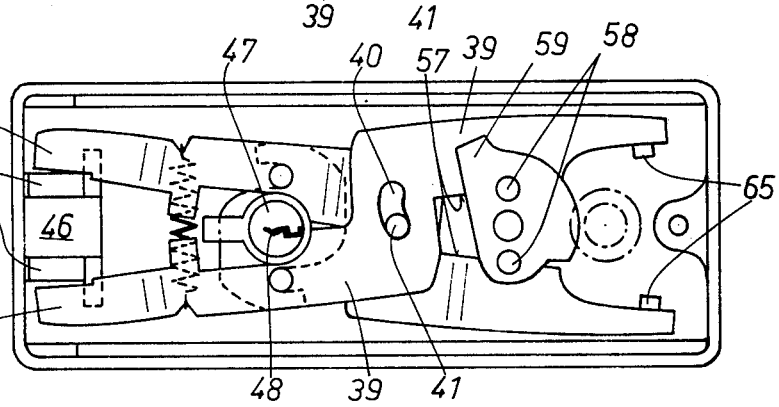

The key-operable disk 50 further has slits 52 which in the normal position of FIGS. 6–8 receive the pins 51 of the levers 39 to immobilize them. Upon such immobilization the pins 51 of the levers 39 serve as axes of rotation or fulcra for the levers 39. In the front wall 25 of the housing 24, an actuating handle 53 is rotatably supported. The shaft 54 of the actuating handle 53 passes through the space between the other lever ends 55 (referred to above as second extremities) and is provided at its free end with a disk 56 or cam plate carrying two eccentrically arranged pins 58 which flank the shaft 54 for camming engagement with the inner edges 57 of the lever ends 55. The disk 56 furthermore has a projection 59 which can be swung into an undercut 61 provided on a latch bolt 60 by turning the actuating handle 53 through 180° from the position of FIG. 7 to that of FIG. 6, the bolt 60 being mounted on the plate 21 which is to be fastened to the door 13 and projecting through a corresponding opening 62 in the cover 28 provided on the housing 24. The bolt 60 has a spherically convex head 63 overlying it undercut 61.

The levers 39 which are rotatably supported on the pin 41 bear on one side, via a supporting pedestal 64 placed over the pin 41, against the front wall 25 of the housing 24 and on the other side, via their bent ends 42 and bent projections 65 provided on their other ends 55, against the cover 28 so as to be secured against displacement along the axis of pin 41.

In FIG. 7, comming disk 56 provided with pins 58 is shown in its normal position. By turning the disk 56 through about 90° into the position shown in FIG. 8, the user presses the pins 58 against the inner edges 57 of the lever ends 55 so that extremities 42 and 55 are spread apart as the two levers 39 swing in opposite directions about the fulcral pins 41 which occupy the slits 52 of the disk 50 of the lock cylinder 47. During this swing the levers 39 move via their slots 40 with reference to the dowel 51 provided on the cover 28. In the position of the levers 39 shown in FIG. 8, the detent 12 is disengaged from the link 15. The opening of the lock 10 by the actuating handle is thus possible. When the door is ajar, the pivot pins 23 lie in the path of movement of the lever ends 55 (as indicated diagrammatically in FIG. 9) so that the lever ends are blocked and a swing about pins 51 is prevented. Thus, a person standing in front of the door cannot reach through the gap of the door and open the lock by manipulating the actuating handle 53. In FIG. 6, the levers 39 and the disk 56 provided with the comming pins 58 are shown in the latching position in which opening the door is completely prevented. In this position the levers are not spread apart so that the link 15 remains coupled with detent 12 fastened to the door post 11. Furthermore, the projection 59 of the disk 56 engages in the undercut 61 of the bolt 60 so that the link 15 is anchored to the bolt 60 and thus to the plate 21 fastened to the door 13. The door 13 can thus not be opened even a crack.

Figure 9:
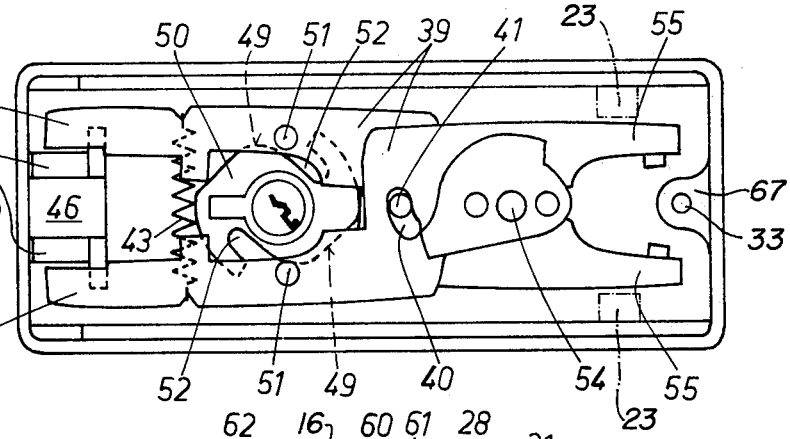
Figure 10:
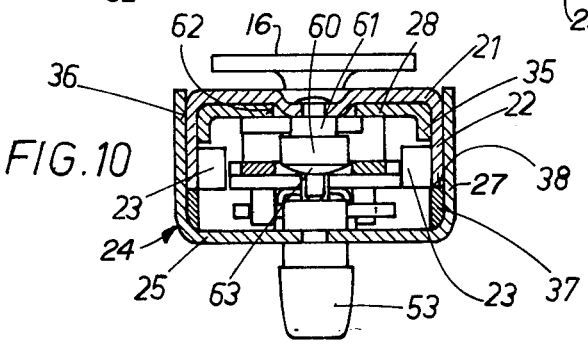
FIG. 10 is a sectional view taken along the line X—X of FIG. 5. Specific Description The lock 10 shown in the drawing consists of a detent 12 which is to be fastened to a door post 11, a keeper 14 which is to be fastened to the leaf of a door 13 and a connecting link 15 which is slidably articulated to the keeper 14 and can be pivotally coupled with the detent 12 for opening the door 13 to a slight extent.

As will be apparent from FIG. 9, the presence of pivot studs 23 adjacent the lever extremities 55 does not impede the release of the gripper jaws 42 from detent 12 by the key-operable unlocking means represented by the cams 49 of retaining disk 50. It will also be understood that the position of FIG. 9 cannot be established unless camming plate 59 is in its unlatching position (cf. FIG. 7) in order to enable a partial opening of the door, as shown in FIG. 2, giving access to the key channel 48. The arrangement shown and described is only intended to illustrate the manner in which the invention can be carried out in practice, and the invention is not limited to this embodiment which can be modified in various ways.

I claim:

1. A lock for a door having a door leaf swingable toward one side from an adjoining door post, comprising:

a keeper provided with pivot means and adapted to be secured to said door leaf at said one side;

a detent fastenable to said door post at said one side; and a link provided at one end with gripper means for engaging said detent and with key-operable unlocking means for disengaging said gripper means from said detent, said link having a track permanently engaged by said pivot means and extending from said one end to the opposite end of said link for slidably articulating said link to said keeper and, with said detent engaged by said gripper means, allowing limited displacement of the door leaf away from the door post to an extent determined by the length of said track, said unlocking means being accessible through a gap existing between the door leaf and the door post upon such limited displacement.

2. A lock as defined in claim 1 wherein said link forms a housing fitting around said keeper in a normal position with said pivot means lying close to said one end.

3. A lock as defined in claim 2 wherein said keeper comprises a back plate provided with a pair of parallel formations extending into said housing, said pivot means being a pair of confronting studs carried on said formations.

4. A lock as defined in claim 3 wherein said formations are ribs perpendicular to said back plate extending laterally beyond said back plate.

5. A lock as defined in claim 4 wherein said housing has a substantially rectangular front wall, a peripheral wall, and a rear cover resting against said back plate in said normal position, said unlocking means being accessible through said cover, said peripheral wall being separated from said cover by longitudinal clearances receiving said ribs.

6. A lock as defined in claim 5 wherein said cover is provided with a pair of bent-over lips adjacent said clearances forming said track.

7. A lock as defined in claim 5 wherein said housing is provided on said peripheral wall with a pair of internal ledges forming abutments for said ribs in said normal position.

8. A lock as defined in claim 2 wherein said keeper is provided with manually operable release means for disengaging said gripper means from said detent independently of said unlocking means.

9. A lock as defined in claim 8 wherein said release means is blockable by a positioning of said pivot means adjacent said opposite end, thereby preventing disengagement of said gripper means from said detent with the door ajar by manipulation of said release means through said gap.

10. A lock as defined in claim 9, further comprising a pair of substantially mirror-symmetrical levers in said housing having first extremities close to said one end constituting said gripper means and second extremities close to said opposite end, said pivot means including a pair of studs flanking said second extremities in their blocking position adjacent said opposite end.

11. A lock as defined in claim 10 wherein said levers are provided with respective pins normally immobilized by said unlocking means to form fulcra for the swinging of said levers between an engaging position and a disengaging position, further comprising spring means urging said levers into said engaging position, said unlocking means being key-operable to free said pins and to move said levers against the force of said spring means into said disengaging position.

12. A lock as defined in claim 11 wherein said levers have arcuate guide slots intermediate said first and second extremities, said housing being provided with a dowel traversing said guide slots.

13. A lock as defined in claim 11 wherein said housing has a substantially rectangular front wall, a peripheral wall, and a rear cover resting against said keeper in said normal position, said unlocking means being accessible through said cover, said peripheral wall being separated from said cover by longitudinal clearances receiving portions of said keeper carrying said studs, said dowel being mounted on said cover.

14. A lock as defined in claim 13, further comprising a latch member on said keeper projecting into said housing in said normal position, said release means being engageable with said latch member for preventing said limited displacement of the door leaf.

15. A lock as defined in claim 14 wherein said latch member comprises a bolt provided with an undercut, said release means including a rotatable plate having a projection engageable with said undercut.

16. A lock as defined in claim 15 wherein said rotatable plate is provided with a shaft penetrating said front wall, said release means further including a handle on said shaft outside said housing.

17. A lock as defined in claim 16 wherein said release means further includes a pair of camming elements on said rotatable plate flanking said shaft and coacting with said second extremities.

18. A lock as defined in claim 15 wherein said bolt is provided with a convex head overlying said undercut.

19. A lock as defined in claim 11 wherein said unlocking means comprises a disk rotatable about an axis parallel to said pins, said disk being provided with slits normally occupied by said pins and with camming surfaces adjacent said slits bearing on said pins upon removal of said slits therefrom.

20. A lock as defined in claim 11 wherein said detent comprises an arm straddled by said first extremities, said arm terminating in a pair of opposite projections respectively overlying said first extremities in said engaging position.

21. A lock as defined in claim 20 wherein said projections have oblique surfaces for separating said first extremities against the force of said spring means upon introduction of said arm into said housing, said levers being provided with confronting stops holding said first extremities sufficiently spaced apart in said disengaging position to facilitate their coaction with said oblique surfaces.

22. A lock as defined in claim 20 wherein said arm is a generally L-shaped hook with a generally T-shaped free end, the bar of the T forming said projections.

23. A lock as defined in claim 20 wherein said housing is provided with a detachable rear cover having a cutout for the entry of said arm and internal concave seats for said projections opposite said cutout.

24. A lock as defined in claim 23 wherein said housing has a pair of opposite sidewalls, one of said sidewalls being apertured and receiving parts of said cover extending past said cutout, the other of said sidewalls being provided with an internal boss having a threaded bore registering with a hole in said cover, further comprising a screw traversing said hole and matingly engaging the threads of said bore for fastening said cover to said housing.

* * * * *